US006969312B2

(12) United States Patent
Launius, Jr.

(10) Patent No.: US 6,969,312 B2
(45) Date of Patent: Nov. 29, 2005

(54) HUB CONDITIONING AND ALIGNMENT TOOL

(75) Inventor: William E. Launius, Jr., Millstadt, IL (US)

(73) Assignee: Derby Worx, Inc., Millstadt, IL (US)

( * ) Notice: Subject to any disclaimer, the term of this patent is extended or adjusted under 35 U.S.C. 154(b) by 0 days.

(21) Appl. No.: 10/658,041

(22) Filed: Sep. 9, 2003

(65) Prior Publication Data

US 2004/0072511 A1 Apr. 15, 2004

Related U.S. Application Data

(60) Provisional application No. 60/410,920, filed on Sep. 16, 2002.

(51) Int. Cl.[7] ..... B24D 15/00
(52) U.S. Cl. ..... 451/523; 451/524
(58) Field of Search ..... 451/523, 524, 451/525, 490

(56) References Cited

U.S. PATENT DOCUMENTS

| | | | | |
|---|---|---|---|---|
| 707,082 | A * | 8/1902 | Brown | 451/515 |
| 915,325 | A | 3/1909 | Bartol | |
| 930,695 | A | 8/1909 | Royle | |
| 1,427,503 | A * | 8/1922 | Wake | 451/524 |
| 1,496,728 | A * | 6/1924 | Olson | 451/511 |
| 2,734,320 | A * | 2/1956 | Hoye | 451/524 |
| 3,168,799 | A * | 2/1965 | Johnson | 451/524 |
| 3,375,618 | A * | 4/1968 | Charniga, Jr. | 451/523 |
| 3,638,367 | A * | 2/1972 | Dreger | 451/524 |
| 3,640,637 | A | 2/1972 | Merz | |
| 3,719,460 | A * | 3/1973 | Brockman | 451/461 |
| 3,797,055 | A * | 3/1974 | Greene | 7/138 |
| 4,091,525 | A | 5/1978 | Karasiewicz et al. | |
| 4,538,612 | A * | 9/1985 | Patrick, Jr. | 606/131 |
| 5,020,221 | A | 6/1991 | Nelson | |
| 5,195,278 | A * | 3/1993 | Grove | 451/524 |
| 5,359,818 | A | 11/1994 | Costa | |
| 5,427,477 | A | 6/1995 | Weiss | |
| 5,558,835 | A * | 9/1996 | Kozarsky et al. | 422/56 |
| 5,890,252 | A * | 4/1999 | Mellon | 15/104.001 |
| 2003/0019665 | A1 | 1/2003 | Horton | |

* cited by examiner

*Primary Examiner*—M. Rachuba
(74) *Attorney, Agent, or Firm*—Charles C. McCloskey

(57) ABSTRACT

The hub conditioning and alignment tool for a wooden car has a cylindrical handle with two opposed faces. A first shaft extends perpendicular to the first face and a second shaft extends perpendicular to the second face. The shafts terminate in tips with depressions. In use, a child squares the hub on the first face and cones the hub on the second face with sandpaper. A child twists the first tip into the axle hole of the wheel for reaming. The steel tool reduces friction between a hub and a car and aligns a wheel with the track to increase the speed of a car.

9 Claims, 2 Drawing Sheets

HUB CONDITIONING AND ALIGNMENT TOOL

CROSS REFERENCE TO RELATED APPLICATION

This application is a non-provisional application of and claims priority to provisional application Ser. No. 60/410,920, filed on Sep. 16, 2002, the disclosure of which is herein incorporated by reference.

BACKGROUND OF THE INVENTION

1. Field of the Invention

The present invention relates to a Hub Conditioning and Alignment Tool for use as a hand tool in connection with model cars. The Hub Conditioning and Alignment Tool has particular utility for finishing the hubs of wheels.

2. Description of the Prior Art

As winter loosens its grip, children emerge from homes across the land for a contest: the Pinewood Derby®. For the derby, children and their adult sponsors assemble a wooden car from a kit and then race their cars against those of fellow children upon a track. Children that win local races advance to tournaments. As a car race, speed remains essential to victory and fractions of a second count. Children and sponsors seek to minimize wheel friction and align wheels precisely at each opportunity. The wooden cars have four wheels. Each plastic wheel has a finished face, a rim, and a centered hub opposite the finished face. The hub fits over an axle hammered into the car. Spinning upon the axle, the hub contacts the car.

A unique aspect of the present invention is squaring the hub manually with few power tools. Squaring orients the hub perpendicular to the axis of rotation of the wheel. Prior art designs squared the hub in a lathe or a drill. A sponsor would install the wheel in a lathe, rotate the hub, and apply a tool to square the hub. Then to reduce the contact area between the hub and a car, a conventional design requires a sponsor to trim the hub manually with a knife also known as coning. Because of lathe tools and a manually trimmed hub, children had less involvement in fine-tuning their cars and slower cars. In summary, prior art requires power tools handled by sponsors while children sat out the fine-tuning of their cars for speed.

The difficulty in providing squared and coned hubs by children is shown by the operation of a typical device. From the factory, hubs have burrs and slight imperfections. Installed upon a lathe, an as delivered hub will cause the wheel to rotate out of round. Tools applied to such a wheel will alter the rim, increase friction between the wheel and the track, and reduce the speed of a car. Typically, sponsors and children remove burrs and square the hub by hand with a sanding block. Such a manual method may not accurately square the hub. The present invention overcomes this difficulty.

The present art overcomes the limitations of the prior art. Hub Conditioning and Alignment Tools are desirable for allowing children to square and to cone their wheel hubs. The present art further allows a reduction in friction between a hub and a car, and a more precise alignment of a wheel with the track. Hubs finished by the Hub Conditioning and Alignment Tool make faster cars.

Akin to the present invention, reaming tools are known in the prior art. For example, U.S. Pat. No. 3,797,055 to Greene discloses a tool for removing light bulb bases and cleaning light bulb sockets. However, the Greene '055 patent does not use sandpaper as an abrasive, and has further drawbacks of no ends to square and to cone a wheel placed upon an end.

U.S. Pat. No. 5,427,477 to Weiss discloses a tool for calibrating and deburring pipe ends. However, the Weiss '477 patent does not cone a hub, does not use sand paper, and additionally does not fit the entire head within a pipe.

Similarly, Patent Application 2003/0019665 to Horton discloses a reamer tool that removes accumulations of material from well piping. However, the Horton '665 application does not operate under hand power, and cannot cone a hub.

Similarly, U.S. Pat. No. 5,359,818 to Costa discloses a hand tool and methods of constructing and utilizing the same that extends sandpaper along a blade to sand narrow places. However, the Costa '818 patent does not square and does not cone a hub, and cannot sand upon both ends of the handle.

Similarly, U.S. Pat. No. 5,020,221 to Nelson discloses a pipe chamfer and deburring tool where a blade scrapes and cuts off burrs. However, the Nelson '221 patent does not cone the end of a pipe, and cannot insert the tool within a hole for reaming.

Similarly, U.S. Pat. No. 915,325 to Bartol discloses a pipe-threading tool that expands to fix a head while turning a die about the head. However, the Bartol '325 patent does not square and does cone an end of a pipe, and cannot pull the head to ream a pipe.

Similarly, U.S. Pat. No. 930,695 to Royle discloses a holder for grinding routing cutters that releasably grasps a cutter. However, the Royle '695 patent does not have a tool at both ends, and cannot cone a hub if the cutter were inserted into a hub.

Similarly, U.S. Pat. No. 3,640,637 to Merz discloses an adjustable machine reamer that finishes holes and tubes. However, the Merz '637 patent does not finish the exterior of a tube, and cannot square or cone a hub.

Lastly, U.S. Pat. No. 4,091,525 to Karasiewicz et al. discloses a reamer for fine reaming of ports. However, the Karasiewicz '525 patent does not square or cone the ends of a port, and has the additional deficiency of requiring external power applied to the shank.

While the above-described devices fulfill their respective, particular objectives and requirements, the aforementioned patents do not describe a Hub Conditioning and Alignment Tool that finishes the hubs of wheels. The Greene '055 and Weiss '477 patents make no provision for using sandpaper and to square and to cone hubs. The Horton '665 application and Karasiewicz '525 patent require external power to operate. While the Costa '818 and Bartol '325 patents do not square and cone hubs. The Nelson '221 and Royle '695 patents cannot insert the tool for reaming and for coning respectively. And the Merz '637 patent makes no provision for finishing the exterior of a tube.

Therefore, a need exists for a new and improved Hub Conditioning and Alignment Tool that can be used for finishing the hubs of wheels. In this regard, the present invention substantially fulfills this need. In this respect, the Hub Conditioning and Alignment Tool according to the present invention substantially departs from the conventional concepts and designs of the prior art, and in doing so provides an apparatus primarily developed for the purpose of finishing the hubs of wheels.

SUMMARY OF THE INVENTION

In view of the foregoing disadvantages inherent in the known types of reaming tools now present in the prior art, the present invention provides an improved Hub Conditioning and Alignment Tool, and overcomes the above-mentioned disadvantages and drawbacks of the prior art. As such, the general purpose of the present invention, which will be described subsequently in greater detail, is to provide a new and improved Hub Conditioning and Alignment Tool and method which has all the advantages of the prior art mentioned heretofore and many novel features that result in a Hub Conditioning and Alignment Tool which is not anticipated, rendered obvious, suggested, or even implied by the prior art, either alone or in any combination thereof.

To attain this, the present invention essentially comprises a hand tool for finishing model car wheel hubs that has a handle, a first shaft, and a second shaft. The handle has a first face and an opposite second face. The first shaft extends perpendicular from the first face coaxial with the longitudinal axis of the handle and has a first tip upon the first shaft opposite the first face. Then the second shaft extends perpendicular from the second face coaxial with the longitudinal axis of the handle and having a second tip upon the second shaft opposite the second face. The first tip and the second tip each have a depression. Also, the second face has a depression generally across its diameter.

There has thus been outlined, rather broadly, the more important features of the invention in order that the detailed description thereof that follows may be better understood and in order that the present contribution to the art may be better appreciated.

The invention may also include a handle cylindrical in shape with ribs; the first shaft and the second shaft fitting within the hub of a wheel; depressions in the first tip, the second tip, and the second face have their nadirs towards the center of the tool; and the first face has a ledge to debur a wheel hub. Additional features of the invention will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and the scope of the present invention.

It is therefore an object of the present invention to provide a new and improved Hub Conditioning and Alignment Tool that has all of the advantages of the prior art reaming tools and none of the disadvantages.

It is another object of the present invention to provide a new and improved Hub Conditioning and Alignment Tool that may be easily and efficiently manufactured and marketed.

An even further object of the present invention is to provide a new and improved Hub Conditioning and Alignment Tool that has a low cost of manufacture with regard to both materials and labor, and which accordingly is then susceptible of low prices of sale to the consuming public, thereby making such Hub Conditioning and Alignment Tool economically available to children and their sponsors.

Still another object of the present invention is to provide a new Hub Conditioning and Alignment Tool that provides in the apparatuses and methods of the prior art some of the advantages thereof, while simultaneously overcoming some of the disadvantages normally associated therewith.

Even still another object of the present invention is to provide a Hub Conditioning and Alignment Tool for finishing the hubs of wheels. This allows less contact between the hub and a car body, reducing friction and increasing the speed of the car.

Still yet another object of the present invention is to provide a Hub Conditioning and Alignment Tool for finishing the hubs of wheels. This makes it possible for a child to finish a hub without a power tool.

Still yet another object of the present invention is to provide a Hub Conditioning and Alignment Tool for finishing the hubs of wheels. This makes it possible for a child to square and to cone a hub with minimal risk of injury.

Lastly, it is an object of the present invention to provide a new and improved method of finishing a model car hub by 1) grasping the handle of a hand tool, 2) placing the first tip upon sandpaper, piercing the sandpaper, and locating the sandpaper over the first tip and upon the first face, 3) rotating the hub firmly against the sandpaper upon the first face whereby the hub becomes square allowing a precise fit of the hub wheel to a track, 4) locating the sandpaper over the second tip and upon the second face, and 5) rotating the hub firmly against the sandpaper upon the second face whereby the hub becomes coned lessening the contact between the hub and the model car resulting in higher speed for the model car.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
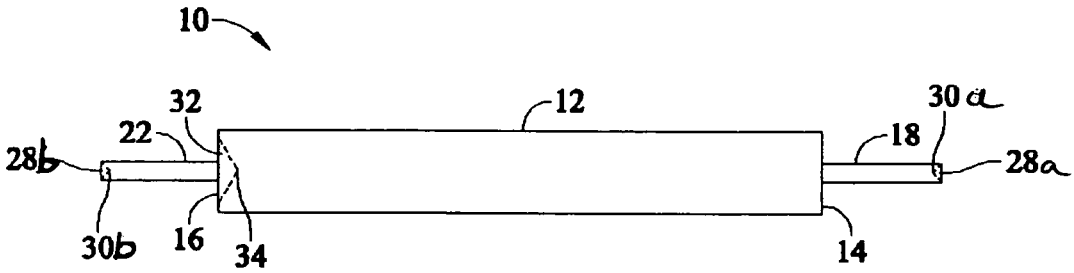
FIG. 1 shows a side view of the preferred embodiment of the hub conditioning and alignment tool constructed in accordance with the principles of the present invention.
Figure 2:
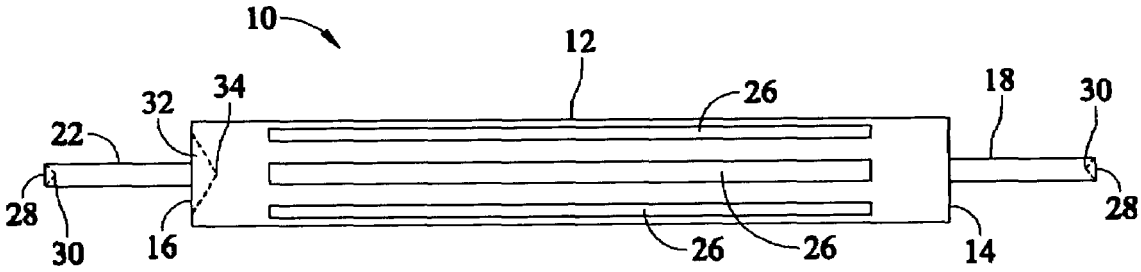
FIG. 2 shows a side view of an alternate embodiment of the hub conditioning and alignment tool constructed in accordance with the principles of the present invention.

Referring now to the drawings, and particularly to FIGS. 1–2, a preferred embodiment of the Hub Conditioning and Alignment Tool of the present invention is shown and generally designated by the reference numeral 10.

Figure 1A:
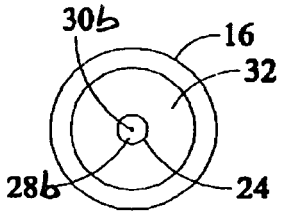
FIG. 1*a* shows a front view of the hub conditioning and alignment tool.
Figure 1B:
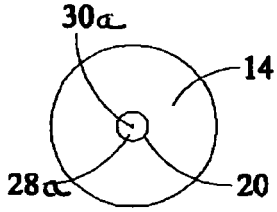
FIG. 1*b* shows a rear view of the hub conditioning and alignment tool.

The present art overcomes the prior art limitations by both squaring and coning a hub by a child without a power tool. In FIG. 1, a new and improved Hub Conditioning and Alignment Tool 10 of the present invention for finishing the hubs of wheels is illustrated and will be described. More particularly, the hub conditioning and alignment tool 10 has a cylindrical handle 12 with two faces. The first face 14 is perpendicular to the longitudinal axis of the handle 12. Coaxial with the handle 12, a first shaft 18 extends perpendicular to the first face 14. The first shaft 18 has a cylindrical shape with a diameter that fits within a hub. Away from the first face 14, the first shaft 18 terminates in a first tip 20. The first tip 20 has a conical depression 28*a* with a diameter generally that of the first shaft 18 in FIG. 1*b*. The conical depression 28*a* points towards the handle 12 as in FIG. 1. In FIG. 1, opposite the first face 14, the hub conditioning and alignment tool 10 has a second face 16, also perpendicular to the longitudinal axis of the handle 12. The second face 16 has a conical depression 32 centered upon the second face 16. This depression 32 points towards the handle 12 and has a diameter that generally exceeds the diameter of a hub in FIG. 1*a*. Coaxial with the handle 12, a second shaft 22 extends perpendicular to the second face 16. The second shaft 22 has a cylindrical shape with a diameter that fits within a hub. Away from the second face 16, the second shaft 22 terminates in a second tip 24. The second tip 24 has a conical depression 28*b* with a diameter generally that of the second shaft 22 shown in FIG 1*a*. The conical depression 28*b* in the second tip 24 points towards the handle 12. That is, the nadir 30*a*, 30*b* of the depressions 28*a*, 28*b* in the first tip 20 and second tip 24 respectively, and the nadir 34 of the depression 32 in the second face 16 are towards the center of the handle 12.

Figure 1C:
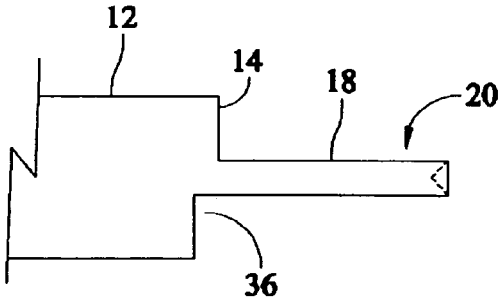
FIG. 1*c* shows a detailed view of an alternate embodiment for the first face of the hub conditioning and alignment tool.
Figure 1D:
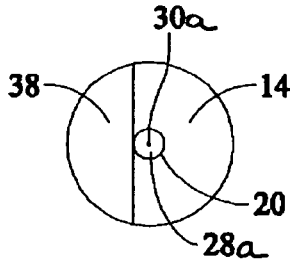
FIG. 1*d* shows a rear view of an alternate embodiment for the first face of the hub conditioning and alignment tool

Moving to FIG. 1*c*, the tool has an alternate embodiment for the first face 14. In FIG. 1*c*, the first face 14 has a ledge 36 touching and adjacent to the first shaft 18 and parallel to the diameter of the first face 14. The depth of the ledge 36 below the first face 14 and towards the center of the handle 12 is sufficient to accept and then to remove burrs from the hub. The inventor has had success using a ledge 36 depth approximately that of the first shaft 18 diameter. In FIG. 1*d*, removing a chord 38 of material from the first face 14 forms the ledge 36. The ledge 36 extends for nearly the diameter and a radius of the first face 14.

Typically, the hub conditioning and alignment tool 10 operates in many environments such as a basement workshop, a garage, trackside, and the like. To utilize the present art, a child grasps the handle 12. In the first alignment, a child places the first tip 20 upon a piece of sandpaper and pierces the sandpaper. A child then places the hole in the sandpaper over the first tip 20 and the first shaft 18, and positions the sandpaper upon the first face 14. With the hub of a wheel placed over the first tip 20 and down the first shaft 18, a child lightly presses the wheel towards the handle 12 and rotates the hub against the sandpaper upon the first face 14. Using the alternate embodiment of the first face 14, (See FIG. 1*c*) a child places the hub of a wheel over the first tip 20 and down the first shaft 18. The child lightly presses the wheel upon the first face 14 and rotates the hub across the ledge 36. From the first alignment, the child squares the hub allowing for further preparation of the rim and a precise fit of the wheel to the track.

In the second alignment following the first alignment, a child places the second tip 24 upon a piece of sandpaper and pierces the sandpaper. A child then places the hole of the sandpaper over the second tip 24 and the second shaft 22, and positions the sandpaper upon the second face 16 and within the conical depression 32. With the hub of a wheel placed over the second tip 24 and down the second shaft 22, a child lightly presses the wheel by hand and rotates the hub against the sandpaper upon the second face 16. From the second alignment, the child cones the hub allowing less surface area of the hub to contact with the car. Coning lessens friction between the hub and the car resulting in higher car speeds.

The preferred embodiment uses steel and round cross sections perpendicular to the longitudinal axis of the invention for the handle, the first shaft, and the second shaft. In an alternate embodiment, the handle has longitudinal ribs 26 arrayed in a regular pattern upon the perimeter of the handle as shown in FIG. 2. The ribs 26 assist in turning the handle 12 and prevent slipping. In a further alternate embodiment, the handle is constructed of heavy duty plastic, such as Lucite®.

While a preferred embodiment of the Hub Conditioning and Alignment Tool has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Although finishing the hubs of wheels has been described, it should be appreciated that the Hub Conditioning and Alignment Tool herein described is also suitable for finishing the ends of pipes and tubes.

From the aforementioned description, a hub conditioning and alignment tool has been described. The hub conditioning and alignment tool is uniquely capable of squaring and coning hubs of wheels. The hub conditioning and alignment tool and its various components may be manufactured from many materials including but not limited to ferrous and non-ferrous metals and their alloys, plastics, woods, and composites.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hand tool for finishing model car wheel hubs, comprising:

a handle having a generally cylindrical shape, a round cross section on a plane perpendicular to the longitudinal axis of said handle suitable for manual gripping, a first face and an opposite second face;

said first face being perpendicular to the longitudinal axis of said handle;

said second face being perpendicular to the longitudinal axis of said handle;

a first shaft extending perpendicular from said first face coaxial with the longitudinal axis of said handle and having a first tip upon said first shaft opposite said first face;

said first shaft having a generally cylindrical shape, a diameter less than said handle and suitable for a hole in said wheel hub;

said first tip having a conical depression with the nadir of said depression towards the center of said handle;

a second shaft extending perpendicular from said second face coaxial with the longitudinal axis of said handle and having a second tip upon said second shaft opposite said second face; and, said second face having a conical depression with the nadir of said depression towards the center of said hand tool and the base of said depression opposite said first face, said base having a diameter substantially that of said handle.

2. The hand tool of claim 1 further comprising:

said second shaft having a generally cylindrical shape, a diameter less than said handle and suitable for a hole in said wheel hub, and being centered within the conical depression of said second face; and, said second tip having a conical depression with the nadir of said depression towards the center of said hand tool and the base of said depression opposite said second face.

3. The hand tool of claim 1 further comprising:

said first face having a ledge formed upon removing material of said handle on a chord adjacent to said first shaft and parallel to the diameter of said first face and to a depth of one or more diameters of said first shaft.

4. A hand tool to finish wheel hubs of model cars, comprising:

a first shaft coaxial with the longitudinal axis of said hand tool and having a first tip upon said first shaft;

said first shaft having a generally cylindrical shape, a diameter suitable for a hole in said wheel hub; and, said first tip has a conical depression with the nadir of said depression towards the center of said hand tool:

a handle having a generally cylindrical shape, a round cross section on a plane perpendicular to the longitudinal axis of said handle suitable for manual gripping, a first face and an opposite second face, said first shaft extending perpendicular to said first face and said first tip being opposite said first face, said first face is perpendicular to the longitudinal axis of said handle; and, a second shaft extending perpendicular from said second face coaxial with the longitudinal axis of said handle and having a second tip upon said second shaft opposite said second face.

5. The hand tool of claim 4 further comprising:

said second face being perpendicular to the longitudinal axis of said hand tool, having a conical depression with the nadir of said depression towards the center of said hand tool and the base of said depression opposite said first face, said base having a diameter substantially that of said handle.

6. The hand tool of claim 5 further comprising:

said second shaft having a generally cylindrical shape, a diameter less than said handle and suitable for a hole in said wheel hub, and being centered within said conical depression of said second face; and, said second tip having a conical depression with the nadir of said depression towards the center of said hand tool and the base of said depression opposite said second face.

7. The hand tool of claim 4 further comprising said first face having a ledge formed upon removing material of said handle on a chord adjacent to said first shaft and parallel to the diameter of said first face and to a depth of generally one or more diameters of said first shaft.

8. The hand tool of claim 1 further comprising said second face having a ledge formed upon removing material of said handle on a chord adjacent to said second shaft and parallel to the diameter of said second face and to a depth of generally one or more diameters of said second shaft.

9. The hand tool of claim 4 further comprising said second face having a ledge formed upon removing material of said handle on a chord adjacent to said second shaft and parallel to the diameter of said second face and to a depth of generally one or more diameters of said second shaft.

* * * * *